US009174230B2

(12) United States Patent
Anfindsen et al.

(10) Patent No.: US 9,174,230 B2
(45) Date of Patent: Nov. 3, 2015

(54) PAINT DOSAGE DEVICE AND SYSTEM ADAPTED FOR A PROGRAM CONTROLLED SPRAY PAINTING APPARATUS

(75) Inventors: Ole Arnt Anfindsen, Sandnes (NO); Tor Ekenberg, Sandnes (NO); Kenneth Mikalsen, Bryne (NO)

(73) Assignee: ABB AS, Billingstad (NO)

( * ) Notice: Subject to any disclaimer, the term of this patent is extended or adjusted under 35 U.S.C. 154(b) by 1846 days.

(21) Appl. No.: 11/663,659

(22) PCT Filed: Sep. 23, 2004

(86) PCT No.: PCT/IB2004/003104

§ 371 (c)(1),
(2), (4) Date: May 12, 2008

(87) PCT Pub. No.: WO2006/032943

PCT Pub. Date: Mar. 30, 2006

(65) Prior Publication Data

US 2008/0217442 A1 Sep. 11, 2008

(51) Int. Cl.

| | |
|---|---|
| ***B05B 15/02*** | (2006.01) |
| ***B05B 9/00*** | (2006.01) |
| ***B05B 5/00*** | (2006.01) |
| ***B05B 5/16*** | (2006.01) |
| ***B05B 12/14*** | (2006.01) |

(52) U.S. Cl.
CPC ..... *B05B 5/1633* (2013.01); *B05B 12/1463* (2013.01)

(58) Field of Classification Search
CPC ..... B05B 12/1463; B05B 5/1633
USPC ..... 239/112, 690, 691, 708, 124–127, 3, 239/68, 69, 106, 114; 251/240; 134/166 C, 134/168 C; 118/302, 323, 300; 901/43; 141/198, 192, 104, 100, 98, 95, 94, 91, 141/89, 67, 27, 21, 18, 9, 2
See application file for complete search history.

(56) References Cited

U.S. PATENT DOCUMENTS

| | | | | | |
|---|---|---|---|---|---|
| 4,785,760 | A | * | 11/1988 | Tholome | 118/323 |
| 4,936,510 | A | * | 6/1990 | Weinstein | 239/223 |
| 5,102,045 | A | * | 4/1992 | Diana | 239/3 |
| 5,238,029 | A | * | 8/1993 | Akeel | 141/2 |
| 5,255,856 | A | * | 10/1993 | Ishibashi et al. | 239/691 |
| 5,630,552 | A | * | 5/1997 | Anfindsen et al. | 239/708 |
| 5,772,125 | A | * | 6/1998 | Ehinger et al. | 239/694 |

(Continued)

FOREIGN PATENT DOCUMENTS

EP 0317155 A2 5/1989

OTHER PUBLICATIONS

PCT/ISA/210—International Search Report.

*Primary Examiner* — Len Tran
*Assistant Examiner* — Steven M Cernoch
(74) *Attorney, Agent, or Firm* — Venable LLP; Eric J. Franklin

(57) ABSTRACT

A dosing device for a program controlled spray painting apparatus adapted for dosing electrically conductive fluid materials to a spray gun/applicator. The spray gun may be charged at a high voltage for electrostatically charged atomizing of electrically conductive fluid materials. A coating system includes the dosing device, which is moved by an actuator between a connecting member for a paint filling line or a cleaning fluid supply line, and a spray gun. A method and a computer program for carrying out the method.

16 Claims, 12 Drawing Sheets

(56) References Cited

U.S. PATENT DOCUMENTS

| | | | | |
|---|---|---|---|---|
| 6,309,464 | B1 * | 10/2001 | Anfindsen | 118/668 |
| 6,391,392 | B1 * | 5/2002 | Thome et al. | 427/477 |
| 6,443,371 | B1 * | 9/2002 | Arnfindsen | 239/373 |
| 6,533,861 | B1 * | 3/2003 | Matsuda et al. | 118/323 |
| 6,702,893 | B2 * | 3/2004 | Thome et al. | 118/302 |
| 6,712,285 | B2 * | 3/2004 | Provenaz et al. | 239/1 |
| 6,755,913 | B1 * | 6/2004 | Kobayashi et al. | 118/620 |
| 6,945,483 | B2 * | 9/2005 | Clifford et al. | 239/690.1 |
| 7,549,449 | B2 * | 6/2009 | Herre et al. | 141/91 |
| 7,781,012 | B2 * | 8/2010 | Schaefer | 427/180 |
| 8,025,026 | B2 * | 9/2011 | Le Strat et al. | 118/679 |
| 2002/0046699 | A1 * | 4/2002 | Congard et al. | 118/323 |
| 2003/0042340 | A1 * | 3/2003 | Clifford et al. | 239/690 |

* cited by examiner

PAINT DOSAGE DEVICE AND SYSTEM ADAPTED FOR A PROGRAM CONTROLLED SPRAY PAINTING APPARATUS

CROSS-REFERENCE TO RELATED APPLICATIONS

This application is the national phase under 35 U.S.C. §371 of PCT/IB2004/003104.

TECHNICAL FIELD

The invention concerns a dosing device for a spray painting apparatus adapted for dosing electrically conductive fluid materials to a spray gun/applicator, and in particular for a spray gun/applicator being provided with a high tension electrode for electrostatically charged atomizing of electrically conductive fluid materials. In another aspect of the invention an actuator for connecting and disconnecting the dosing device is described, as well as a system for spray painting.

TECHNICAL BACKGROUND

The present invention is related to a paint dosage device, preferably adapted for mounting in close proximity to a spray gun, and for use in a program controlled spray painting installation. The paint dosage device provides for a dosed paint supply to the spray gun, and in particular for the case in which the spray gun is provided with high tension electrode for electrical atomizing of the supplied electrically conductive paint.

As dosage means for paint supply for solvent borne, non-conductive paint fluid materials to spray guns, cogwheel pumps, dosage by a regulator combined with a measurement device, for example gear meter or other type of flow measurement or the like are used. These solutions are not applicable to application of charged conductive paint materials such as water borne paint. Application of conductive or water borne paints requires an effective insulation or galvanic blocking between a spray gun/applicator charged with a high voltage and a paint dosing device and/or the paint lines supplying the dosing device.

U.S. Pat. No. 4,785,760 (Tholome), entitled Sprayer installation, describes a sprayer installation that includes a multi-axis robot carrying a spray gun which is suitable for spraying water-based paint. The robot is equipped with a refillable tank arranged on the arm of the robot, near the end with the spray gun. The robot can move the spraying arm, and thus the tank attached to it, over to one side of a paint booth and connect the tank to one of a series of filling or cleaning lines fixed on the wall of the booth. High voltage supply to the spray gun or applicator is switched off when the robot stops spraying, and subsequently switched on again when the filling or colour change or cleaning etc. of the tank has been completed. A disadvantage with this type of solution is that it requires cleaning of the tank when carrying out a colour change and will therefore require a rather long cycle time for cleaning and refilling, in addition to the time necessary for the robot to move to a filling or cleaning station and move back to and re-orient with objects on a painting line. In addition, the demands for uninterrupted production and flexible manufacturing have led to an increased demand for rapid colour changes and/or cleaning operations, which could be a drawback with the described solution in U.S. Pat. No. 4,785,760.

U.S. Pat. No. 5,630,552, (Anfindsen) entitled Paint dosage device for program controlled spray painting system, describes a spray painting installation particularly suitable for the application of electrostatically atomized paint. The dosage device of the installation comprises dosing cylinders. Each dosage cylinder has a regulating piston, respectively, and regulation members for controlling the position and displacement velocity of the regulating pistons in the dosing cylinders. The dosing cylinders also have a controlled valve assembly and connection means for connecting the cylinders alternately to the spray gun and for connecting the cylinder when disconnected from the gun in connection with means for cleansing and refilling of paint. The spray gun may also be provided with a high tension electrode for electrostatically charging the supplied electrically conductive paint, in which case the paint is atomized by means of supplied atomizing air to the gun, the cloud formed by atomized paint particles being suitable shaped for the purpose by a beam of formation air, which also is supplied to the spray gun. The paint being conductive and in contact with the high tension electrode of the spray gun in the present case, the regulation piston of each cylinder is for that reason isolated from its associated driving motor by means of a shaft member made of electrically insulating material. The dosage device described may be mounted in close proximity to a spray gun on a robot arm, it provides accurate dosing of fluid materials (paint) and it is insulated from the paint supply lines.

A disadvantage with the above solution is that the galvanic blocking solution of applying a combination of a blocking device (insulated plunger) and an insulation fluid may be a rather complex solution which could require periodic cleaning of the insulation fluid in order to avoid a build up of any contamination by conductive particles (from paint materials).

Demands for uninterrupted coating production and flexible manufacturing of products, which typically involves shorter production runs, have led to an increased demand for faster, less time consuming colour changes and/or cleaning operations. In addition the paint dosing apparatus must also be well insulated, explosion-proof and reliable, without being excessively difficult or expensive to implement.

SUMMARY OF THE INVENTION

It is an aim of one aspect of the present invention to provide a paint dosage device of the type indicated above, and by which the indicated disadvantages of the prior art dosage means are overcome. It is another aim of the present invention to provide a dosing device that does not require a high voltage supply to be repeatedly switched on and off. It is another aim of the present invention to provide a dosing device that may be re-filled and re-used with a minimum of interruption or delay to the production process.

The above and more aims are achieved according to the invention by a dosing device, by a method and by a system.

In another aspect of the invention an actuator is provided for use with and cooperation with the paint dosage device. The unique inventive feature of the paint dosage apparatus according to the invention is that it is arranged moveable between paint filling and paint spraying connection members; and it comprises at least one dosing device for controlled dosing of fluid paint and at least one valve assembly being arranged for connecting, alternately disconnecting, the dosing device to a spray gun, and alternately to a fluid filling member. The dosing device is arranged movable by the above mentioned actuator and so that the dosing device is galvanically isolated from the spray gun at the time when it is disconnected from the spray gun and subsequently connected to the fluid filling member. The dosing device may be connected to the filling member for the purpose of re-filling the dosing device with paint or other fluid materials, or alternatively for flushing the dosing device with cleaning fluid.

Such a dosing device is particularly suitable in the case the spray gun or other coating applicator is provided with high voltage electrode for electrostatically charged atomizing of a supplied electrically conductive paint, because the dosing device(s) according to an embodiment of the invention are isolated from the paint filling supply and/or cleaner fluid supply by means of an insulating air gap when disconnected from the spray gun.

Isolating the paint dosing device from the parts charged at high voltage, principally the spray gun/applicator, is achieved according to an embodiment of the invention by moving and undocking (uncoupling) the dosing device(s) from a inlet conduit device which is connected to the spray gun. The dosing device may then be moved towards a filling line and connected to an outlet of the filling line. The isolation of the paint device when it is disconnected from the main paint supply (or cleaning fluid supply) and moved toward the spray gun or applicator. The movement of the dosing device(s) may, for example, be efficiently carried out by applying compressed air to an actuator comprising a pneumatic on-off device (air cylinder) to move the dosing device into contact with or out of contact with a valve assembly.

The dosing devices can be moved by the actuator from a back position where the device is connected to the main paint supply lines and is not charged at high voltage, forward to the front position where the dosing device is connected to the spray gun or applicator as well as disconnected from the main paint supply lines. By this means the dosing device is isolated from the main paint kitchen by an air gap when connected to the spray gun and can be subjected to a high voltage charge.

The principal advantage is that the main paint handling systems, the paint lines and the paint kitchen are isolated from system parts, principally the spray gun, that are operated charged at a high voltage. This provides a robust device and system for painting and coating that may also be operated in a flexible way with full freedom to include paint changes, colour changes and/or flushing sequences efficiently and often without interrupting paint or coating production.

In a preferred embodiment where a two or more dosing devices are arranged on a program-controlled automation device, such as an arm of a robot, spraying may continue with paint dosed by one dosing device while a second dosing device is being re-filled, colour changed or flushed, ready for use as soon as the first dosing device is empty. This permits almost uninterrupted spraying, and in particular without any pause or stoppage for for isolation, such as for switching high voltage on and off. The need for heavy-duty, fast-operating isolating equipment or circuit breakers is eliminated, fluctuations in the high voltage power supply system are greatly reduced, and set-up or change over times between paints or colours is reduced to a minimum, greatly supporting both maintenance of quality and requirements for flexible manufacturing. In addition the invention facilitates mounting the spray gun or applicator at an end of the program-controlled automation device, for example mounted on the robot wrist at the end of the robot arm equipped with the dosing device, and thus in very close proximity to the spray gun. This also enable the use of short hose connections to the spray gun and so in that way also minimises paint loss during changeovers. It also allows the possibility of spray paint on objects which require coating with a large volume of paint and/or are arranged close to each other without interrupting the coating process for cleaning and refilling.

In another aspect of the invention methods for operating a program controlled spray painting installation and for connecting and disconnecting the dosing devices are described. A computer program for carrying out the described methods is also disclosed.

BRIEF DESCRIPTION OF THE DRAWINGS

The invention will now be further explained by means of exemplary embodiments and with reference to the accompanying drawings, on which.

DETAILED DESCRIPTION OF THE PREFERRED EMBODIMENTS

Figure 1A:
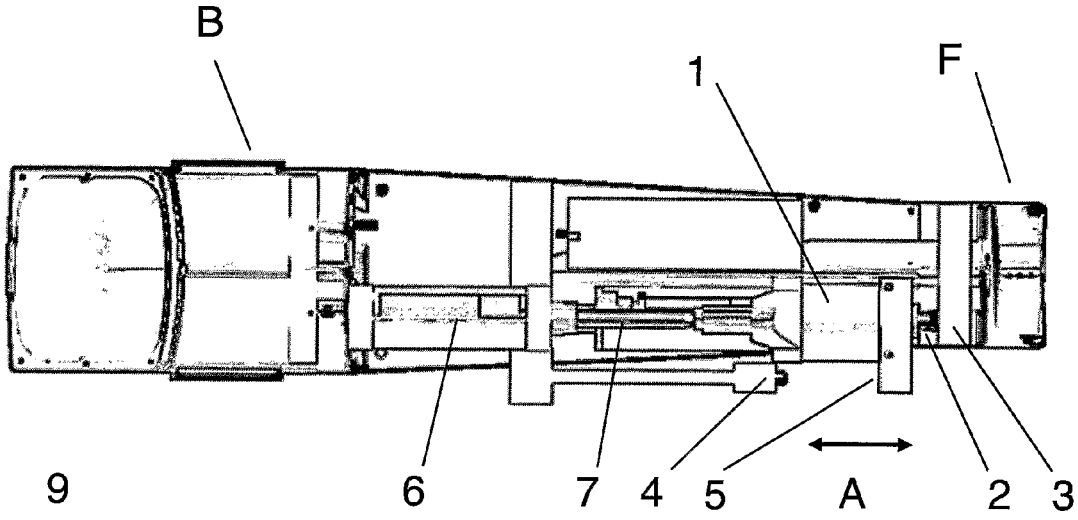
FIG. 1*a* shows a view looking drown from above of a schematic diagram for a paint dosage device and an actuator according an embodiment of the invention mounted on a robot arm.
Figure 1B:
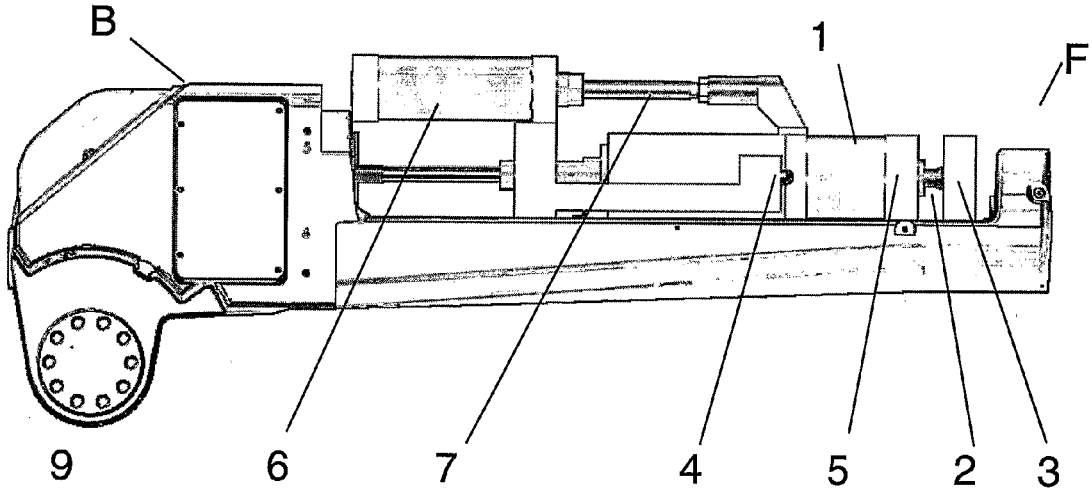
FIG. 1*b* shows a side view of a schematic diagram for the same paint dosage device and the actuator.

FIGS. 1*a* and 1*b* show schematic diagrams for a program-controlled automation device, such as an arm of an industrial robot, which is equipped with a dosing device according to one aspect of the invention and an actuator according to another aspect of the invention. FIG. 1*a* shows a view of a robot arm 9 from above. At the front end F of the arm, beside which a spray gun/applicator would be mounted, a block 3 is shown in which is arranged an inlet valve (3*a*, 3*b* not shown) which is to co-operate with a valve 2 connected through a block 5 to a dosing cylinder 1 of the dosing device. The dosing cylinder in this exemplary embodiment is moved forward and back in the direction indicated by arrow A by an arm 7 of an actuator 6.

In FIGS. 1*a*, 1*b* the dosing cylinder 1 is shown in a middle position, in which block 5 is not docked to member 4, nor is outlet valve 2 docked with block 3. When dosing cylinder 1 is moved forward (right) towards the front F of the robot arm (eg arranged on a robot wrist or similar tool holder), the point besides which a spray gun would be mounted, the outlet valve 2 of the dosing device connects with the inlet valve (3*a*, 3*b* not shown) of block 3. When the dosing device is operated to dose paint, valves (not shown here) downstream of the inlet valve in block 3 allow paint to be supplied to the spray gun or applicator. The spray gun or other applicator may be maintained at a high voltage for electrostatic spraying, as indicated below in reference to FIG. 4.

When the dosing cylinder is moved backwards towards the back B of the robot arm by an arm 7 of the actuator 6, a galvanic connection between docking coupling and valve 2 to block 3 is broken and the dosing cylinder is thereby isolated from the spray gun or applicator parts that may be charged at a high voltage. The dosing cylinder is moved (left) to a back position, where a filling valve member 4 is contacted by a block 5 arranged on the dosing device 1. In the back position the dosing cylinder of the dosing device may be filled with paint, alternatively cleaning fluid, alternatively another colour or type of paint. In this position the dosing cylinder, while being filled with paint materials or cleaning materials, is galvanically isolated from the parts of the system, in particular the spray gun, which may be charged at a high voltage.

In this example, coupling/docking member and filling connection 4 at the back end of the arm is used to alternatively supply paint, alternative types of paint, other colours, other components, or to supply cleaning fluids to the dosing cylinder by valves, conduits etc arranged in block 5. When the dosing cylinder is being cleaned with cleaning fluid etc., it may be moved to the forward position and connected to the inlet valve of block 3, in which various valves (not shown here, see embodiment of FIG. 4 below) downstream of inlet valve 2 may route the cleaning fluid either to the spray gun or dump the spent fluid to a sump for spent cleaning fluid.

To sum up, high voltage isolation of the charged paint dosing part (1, 1*a*, 1*b*, dosing cylinders and the spray gun) is achieved by moving and docking (coupling) the dosing device to a docking or coupling device which is connected to the spray gun and, simultaneously disconnecting the dosing cylinder(s) from the main paint supply 4. The movement of the dosing cylinders can for example be carried out by arranging a pneumatic on-off device (air cylinder) 6 as an actuator. In this way the dosing cylinder may be connected to the spray gun and simultaneously disconnected from the main paint supply lines, and thereby isolated from the main paint kitchen, and so can be charged with high voltage.

Figure 2A:
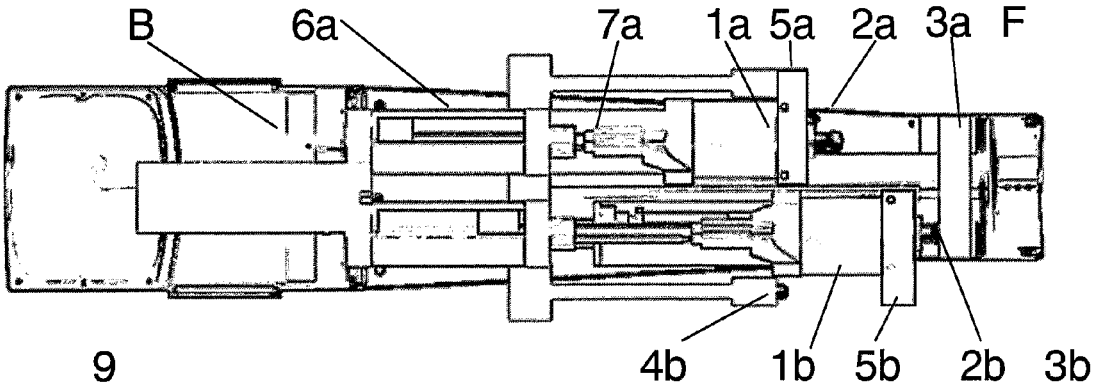
FIG. 2*a* shows a view from above looking down of a schematic model with two paint dosage devices and two actuators according to another embodiment of the invention mounted on a robot arm.
Figure 2B:
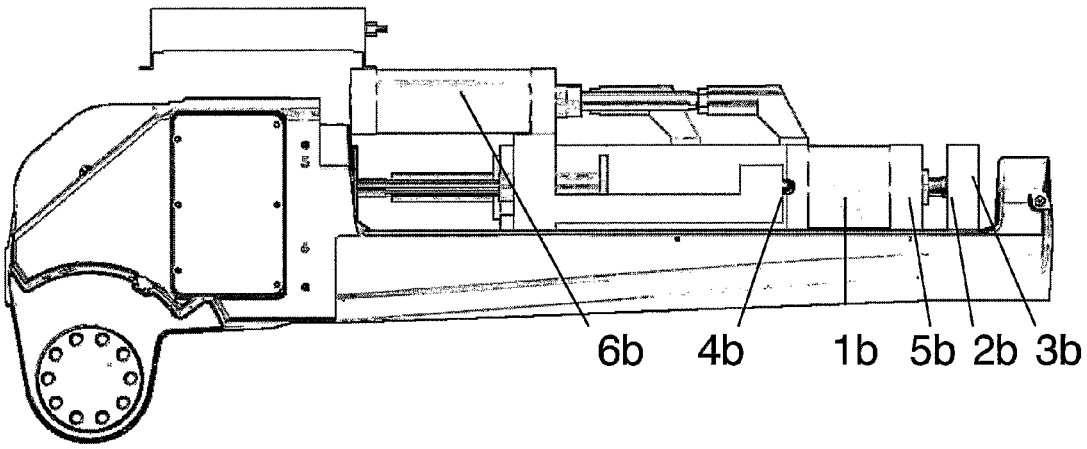
FIG. 2*b* shows a side view of the schematic model.
Figure 2C:
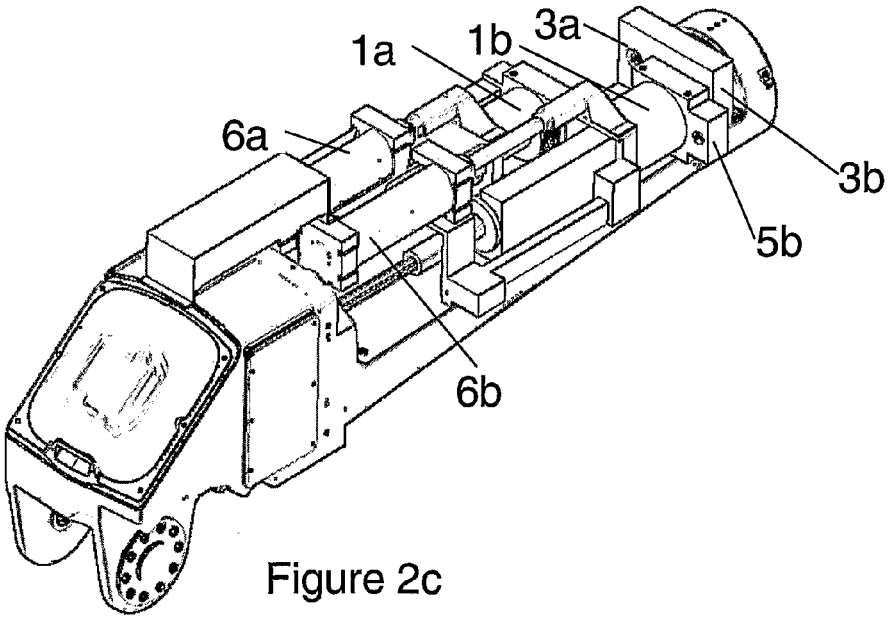
FIG. 2*c* a perspective view.

FIGS. 2*a*, 2*b* and 2*c* show a schematic model for an embodiment of the invention in which two dosing cylinders and two actuators are mounted on a single program-controlled automation device, shown in this example as an arm for an industrial robot, and using the same reference numbers for the same parts, where possible.

FIG. 2*a* shows view from the top of a part of a program-controlled automation device, also as a robot arm, with two dosing cylinders 1*a*, 1*b* each moved back and forward by arms 7*a*, 7*b* of two actuators 6*a*, 6*b*. FIG. 2*b* shows in a side view one actuator 6*b* and one dosing cylinder 1*b* in the foreground. The docking coupling and outlet valve 2*b* of dosing cylinder 1*b* is visible in contact with the block 3 comprising inlet valves and conduits (not shown) to the spray gun. Dosing cylinder 1*b* is seen in a position disconnected from the filling connection coupling-and-valve member 4*b*.

FIG. 2*c*, a perspective view, shows the two dosing cylinders mounted on the robot arm 9, and in this case side by side. Dosing cylinder 1*b* is in a more forward position toward the front (spraying) end dosing cylinder 1*a* is in a back position. An inlet valve member may be seen in block 5*b* which, in the back position during filling or cleaning, cooperates with the valve member 4*b* to connect with dosing cylinder 1*b*. It may be seen that any spray gun or applicator mounted at the front end, F, of the arm would be in close proximity to the valves and inner conduits of block 3. The spray gun thus arranged requires only very short hose or line connections between spray gun and the conduits of block 3, minimising paint loss or wastage of fluid materials during colour changes or flushes.

Block 3 arranged at the front of the arm just before the spray gun attachment (not shown) comprises at least an inlet valve and an inlet conduit (not illustrated in FIG. 1 or 2) for carrying fluid towards the spray gun or applicator. Block 3 may comprise a valve block or other assembly comprising a plurality or valves and/or conduits and/or compressed air supplies to operate valves to provide different fluid flows during different phases of a painting and/or flushing or cleaning process (see for example valve assembly 10 in embodiment of FIG. 4). The block 3 may comprise valve means and conduit means to carry spent cleaning fluid away to a sump or other collection vessel for waste material. Block 5, arranged on the dosing cylinder 1, comprises at least an inlet valve and conduit member (not shown) to convey fluid material such as paint or cleaning fluids from the filling lines into the dosing cylinder.

In the operational phase with two or more dosing cylinders so arranged on one robot arm or other program controlled coating device, a first dosing cylinder 1*b* is flushed clean by means of supplied cleansing liquid through its inlet conduit with block 5*b* in cooperation with a connecting valve at 4*b*. When the cleaning of the first dosing cylinder is completed, its regulating piston is set to a program determined departure position in the cylinder for defining the paint filling amount of dosing cylinder 1*b*. The dosing cylinder 1*b* is then re-filled through the inlet conduit with connecting valve at 4*b*, in order to prepare the dosing cylinder 1*b* for dosed paint supply to the spray gun when a dosing cylinder such as dosing cylinder 1*a* has finished its current dosage.

The regulating piston of the dosing cylinders may be driven by an electric motor or servo motor with a screw-type drive mechanism for the piston and an insulated drive member, of the type disclosed in U.S. Pat. No. 5,630,552 mentioned above. A particularly advantageous improvement is to use a piston that is driven by a non-conductive fluid material, and isolated from any electric motor drive; or a non-conductive fluid material in combination with a mechanical drive from an electric motor. Precise control of the piston in the dosing cylinder by applying a servo controlled drive gives the possibility to fill an exact predefined material (paint) volume to cover the surface and thereby minimize loss of paint when colour changing is required by displacing into the outlet conduit only the predetermined amount of paint needed. This means then that the last filling of the dosage device may be of a lesser amount than a full load, thus minimizing excess paint injected into the lines and applicator that must subsequently be flushed and dumped because of a colour change or component change.

Figure 4:
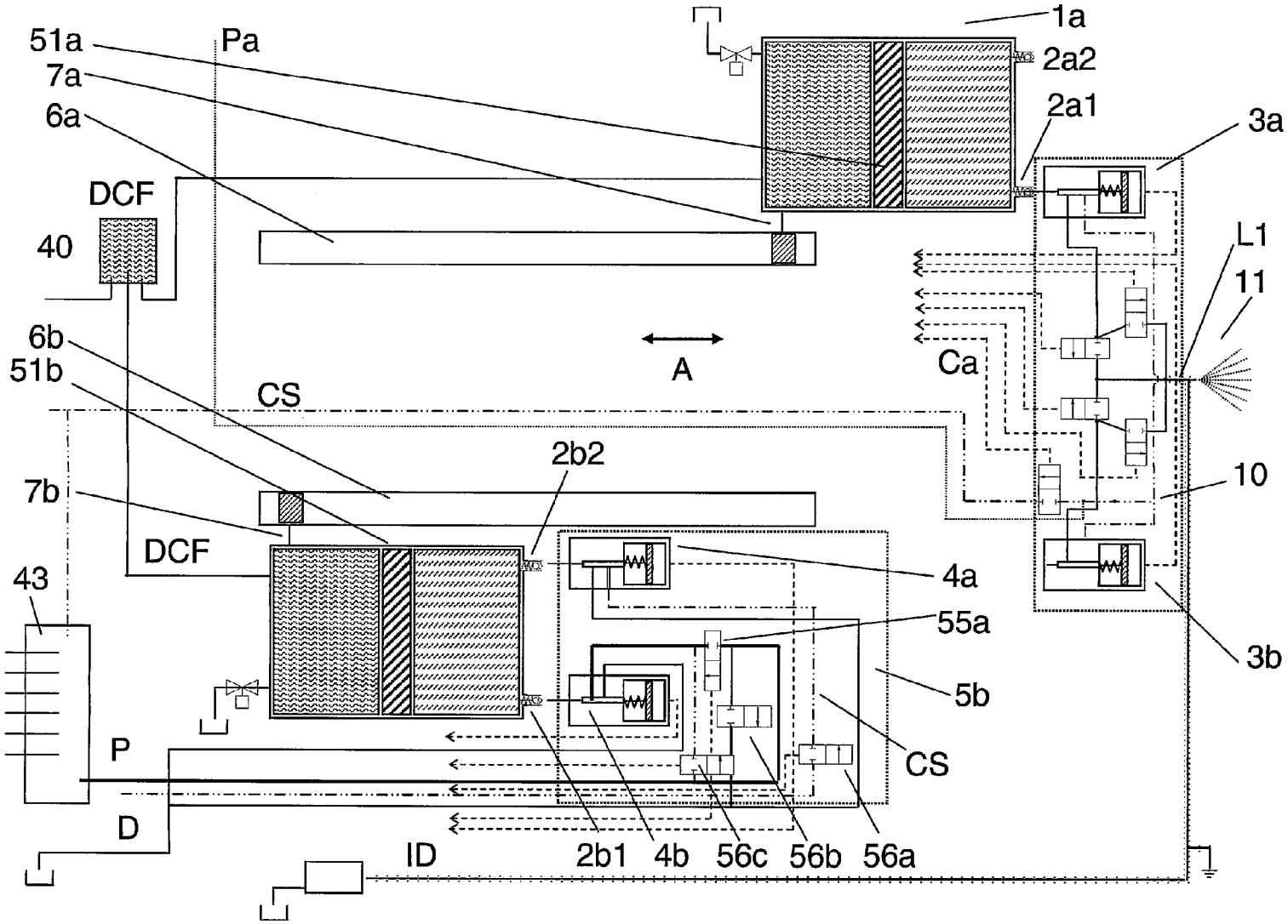
FIG. 4 shows a schematic layout for paint dosage devices and actuators according an embodiment of the invention.

In FIG. 4 a dosing cylinder 1*a* is shown which includes a regulating piston 51*a*, which may in operation be moved against the paint or other fluid in the dosing cylinder by a fluid material denoted as DCF, Dosing Control Fluid. Alternatively the regulating piston 51*a* (and/or 51*b*) may be moved by a combination of an electrically insulated shaft member and a fluid material. Less preferably the regulating piston 51*a*, 51*b* may be replaced with other regulating members suitably arranged, such as a pump, diaphragm, or similar.

FIG. 4 shows schematically a layout for a preferred embodiment. It shows, using again the same reference numbers as before where possible, a spray gun or applicator 11 at the front end, supplied with paint, atomizing air and shaping air and arranged with an electrode charged at high voltage. A valve assembly 10 is shown connected by a conduit 11 to the spray gun. Two dosing devices, dosing cylinders 1*a* and 1*b* are shown. Dosing cylinder 1*a* is shown in the front position connected by outlet valve 2*a*1 and docking valve 3*a* and other valve members in the valve assembly 10 via conduit L1 to the spray gun 11. The other dosing cylinder 1*b* is shown in the back position disconnected and thereby insulated by an air gap from a second docking valve 3*b* of the valve assembly 10 at the front end. Second dosing cylinder 1*b* is instead shown connected via outlet valve 2*b*1 and docking valve 4 and an inlet valve inlet valve 55*a* of the valve block 5*b* and further connected to a grounded filling connection line for Paint Flushing and Filling, P, illustrated by a heavy line in FIG. 4. A plurality of paint supplies are arranged with valve and conduit means 43 to supply one or more fluid materials or paint P via a plurality of inlet and valve combinations to fill the dosing cylinders 1*a*, 1*b*.

Dosing cylinder 1*a* is also connected to a fluid regulation device 40 which may regulate the amount and flow of paint or other fluid material in the dosing cylinder. Alternatively the piston 51*a*, 51*b* or other regulating device of the dosing cylinder may be moved or operated by a combination of a fluid material and an electrically insulted shaft member.

FIG. 4 also shows two actuators, 6*a*, 6*b*, typically powered by compressed air (not shown) and which are each arranged with an arm 7*a*, 7*b* attached to the dosing cylinders 1*a*, 1*b* so as to move each of them respectively forward and back in the direction of arrow A. By this means the dosing cylinders are alternatively connected with, or disconnected from, the spray gun valve block 10 via tandem inlet valves 3*a* or 3*b*, or an inlet 4*a*, 4*b* of valve block 5*b* for connection to the paint filling line or for a cleaning operation. Valve blocks 5 and 10 are illustrated by a surrounding rectangle indicated by dotted (••••) lines.

The docking valves 3*a*, 3*b* etc in the valve assembly 10 or 3 are correspondingly adjusted for the switching the operational functions of the cylinders by means of valve control performed by a connection regulation means, for example powered by compressed air for control purposes, Ca, parts of some of which air lines are indicated in FIG. 4 by dashed (---) lines. Subsequently or periodically the dosing cylinder 1*a* is subjected to flushing with the cleansing liquid denoted CS for Cleaning Solvent, indicated by a dash-dot-dot line (-••). Compressed air may also be used for purging or cleaning functions, as indicated by one exemplary line Pa which may be used to purge paint from the inlet valves and flush used paint and/or solvent to a dump line such as ID. Cleaning solvent is supplied to valve blocks 10 and 5*b* and may be routed by valves through conduits to flush the lines and the spray gun applicator parts as required.

Accordingly a number of dump lines D are shown connected for example to valve block 5*b* for the purpose of channeling flushed paint away to one or more sumps. For example valve 56*a* may be operated to route cleaning fluid CS to the tandem valve and inlet 2*b*2 of dosing cylinder 1*b*, valve 56*c* may route cleaning fluid CS to the tandem valve and even inlet 2*b*1 of dosing cylinder 1*b*, and valve 56*b* may be operated to route material from inlet valve 2*b*1 and lines to a dump D. A particular dump line from the applicator 11 is insulated and grounded and shown indicated ID, Insulated Dump, because the paint and solvent flushed from the applicator 11 may be at a high voltage.

During cylinder cleaning, cleaning fluid is flushed under pressure into the cylinder space in the dosing cylinder, whereupon the supplied liquid together with remaining paint is drained out to a dump for waste liquid, preferably through an outlet via block 3, 10 or a valve assembly of 5*a*, 5*b* or otherwise through another suitable valve or valve assembly. To achieve an uninterrupted or a continuous painting operation, and also to maintain continuity of the coating or paint spraying quality parameters, two or more dosing devices 1*a* and 1*b* may be used alternately for the dosing paint for spraying or for cleaning or flushing and refilling, respectively. Thus one of the dosing devices is refilled (or has a colour change) while a second dosing cylinder supplies paint to the applicator 11, so that the changeover time from an empty dosing cylinder to a full is minimised. When no flushing of the applicator is involved, the changeover time only consists of the time taken for the valves in valve block 10 to switch in flow from the second cylinder and switch out flow from the first. With staggered or valve movements and controlled, ramped fluid filling pressures changeover time may be eliminated entirely. See below in respect of FIG. 6*b*.

Regardless of changeover time there is in any case no need to switch off the high voltage supply to a spraying system according to an embodiment of the invention during operation under normal operations, and therefore no need for equipment or methods to synchronise switching high voltage on and off, coordinated and controlled together with the connection and regulation of the valves.

The embodiment of FIG. 4 may have two valve blocks 5*a*, 5*b* for refilling/flushing even though that diagram only shows one valve block 5*b*.

In another preferred embodiment the filling functions for two or more dosing cylinders such as 1*a*, 1*b* are serviced by one single valve block, such as 5*b*, in a configuration which may be seen from FIG. 4, and shown and described in relation to FIG. 5, below.

One or more extra dosage cylinders of may in certain embodiments of the paint dosage device according to the invention be disposed for dosage of curing agent or another paint component together with paint from one or the other of the dosage cylinders described above. In a case where two components may be dosed in combination to a spray gun, they may preferably be first thoroughly mixed in a mixing device.

Figure 6A:
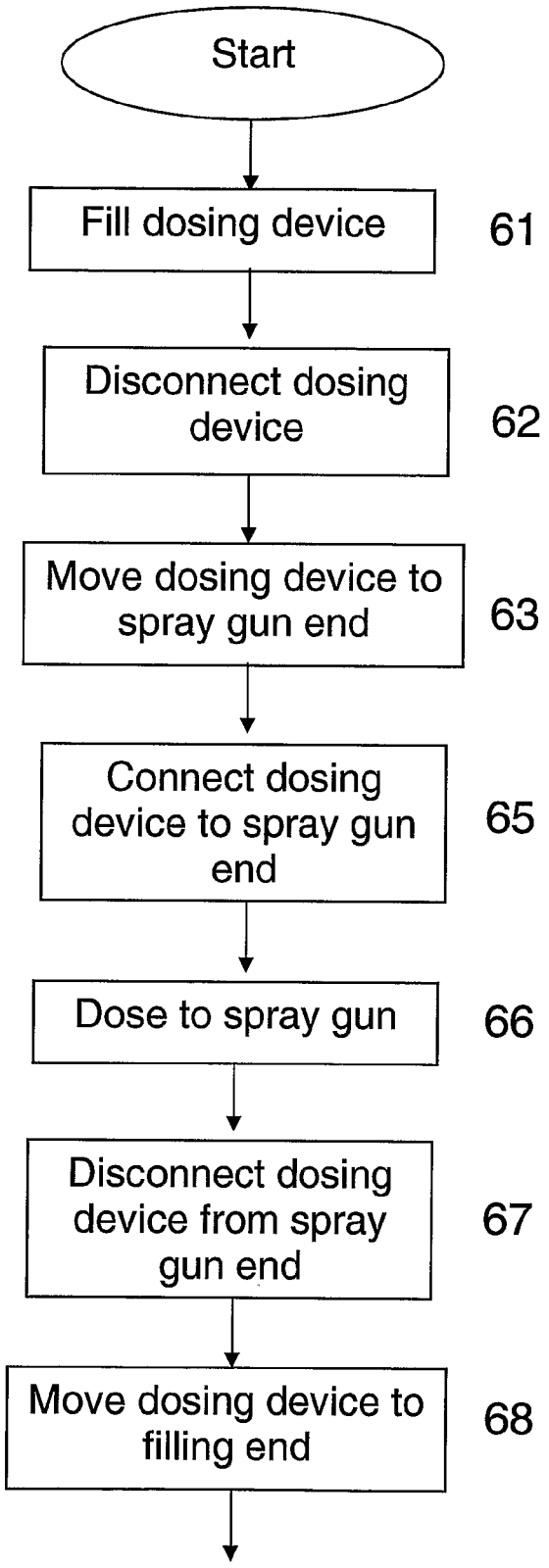
FIG. 6*a* is a flowchart for a method for operating and moving a dosing device from filling to spraying to re-filling, according to an embodiment of the invention.

FIG. 6*a* is a flowchart for a method to carry out steps for dosing a program controlled spray painting apparatus adapted for dosing electrically conductive fluid materials (as waterborne paints, sealant, gluing etc) to a spray gun/applicator. The exemplary method shown may begin at a point in an operating cycle such as:

filling 61*a* first dosing device 1,
disconnecting the first dosing device from the filling end 62,
moving the first dosing device to the spray gun end 63,
connecting the dosing device to an inlet of the spray gun 65, dosing 66 to the spray gun,
disconnecting the first dosing device from the spray gun end 67, and
moving the first dosing device towards the filling end 68.

Figure 6B:
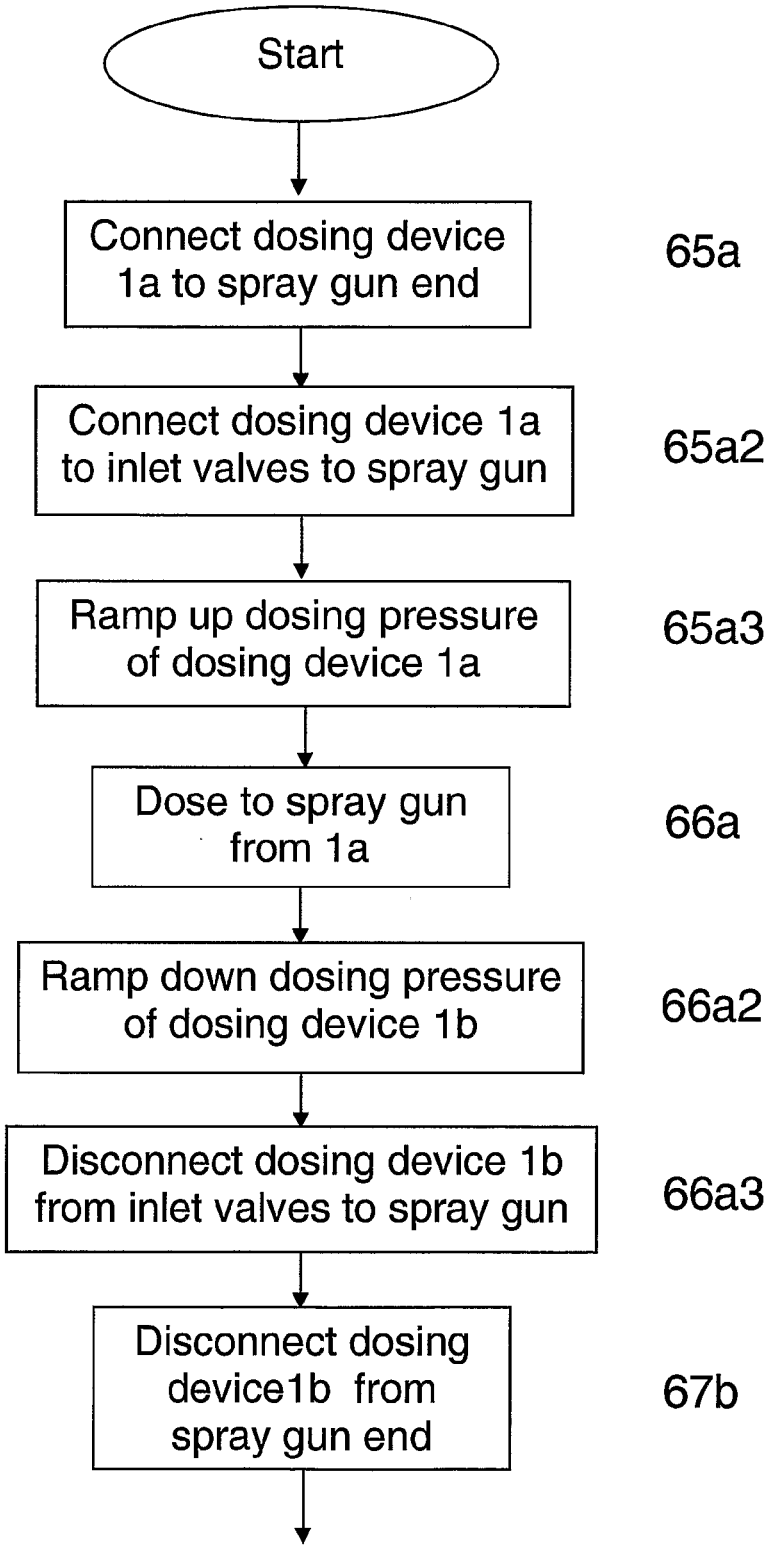
FIGS. 6*b* and 6*c* are flowcharts for methods according to a preferred embodiment of the invention, in particular in respect of FIGS. 3*a*-*c*.

FIG. 6*b* shows a flowchart for continuous painting by means of a more gradual or staged changeover of paint supply from one dosing device to the applicator/spray gun to paint supply from another dosing device. The exemplary method shown may begin at a point in an operating cycle such as (dosing 66 from dosing device 1*b*) and comprise actions of:

connecting the dosing device 1*a* to spray gun inlet 65*a*
connecting inlet valves between dosing device 1*a* and spray gun 65*a*2
ramping up delivery dosing amount on dosing device 1*a* 65*a*3
dosing the spray gun from dosing device 1*a* 66*a* ramping down delivery dosing amount on dosing device 1*b*
66*a*2
disconnecting inlet valves between dosing device 1*b* and spray gun 66*a*3
disconnecting the dosing device 1*b* from spray gun inlet 67*b*

The flowchart indicates that the ramping up of speed of movement of the regulating device, eg piston 51*a* to gradually begin dosing from a filled dosing cylinder eg 1*a*, and the ramping down of speed of the other regulating device eg 51*b* reducing the volume of flow from the used or near-empty dosing cylinder eg 1*b* is carried out in that order. However, the ramping up and ramping down for the two dosing cylinders may be controlled to take place in other sequences, for example such that both ramping periods overlap, periods overlap in part, or ramping periods occur at the same time. The two ramping phases may likewise be controlled to operate for different amounts of time.

The above and other methods described may be carried out by, or under the supervision of, one or more computer programs running at least in part in a system controller, system computer, robot controller, PLC (programmable logic controller) controller or other controller connected to the system.

Figure 3A:
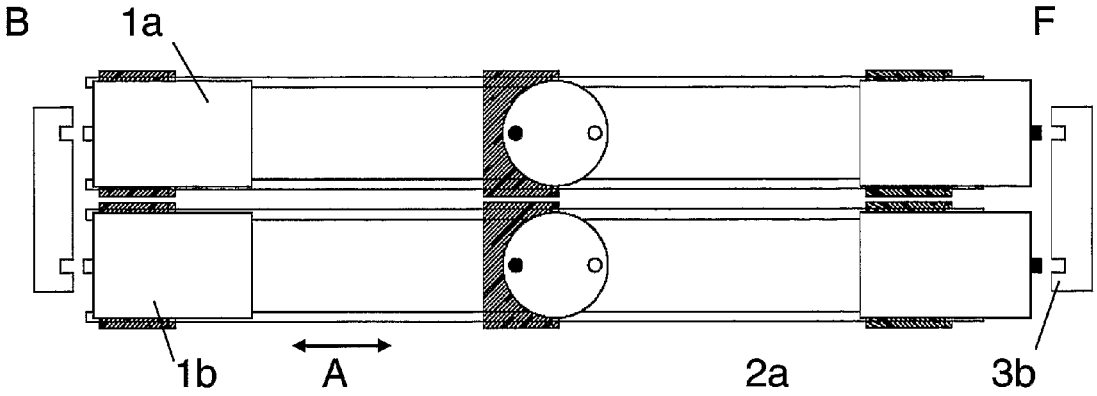
FIG. 3*a* shows a top view looking down from above of a schematic diagram with two paint dosage devices and two actuators according to another preferred embodiment of the invention.
Figure 3B:
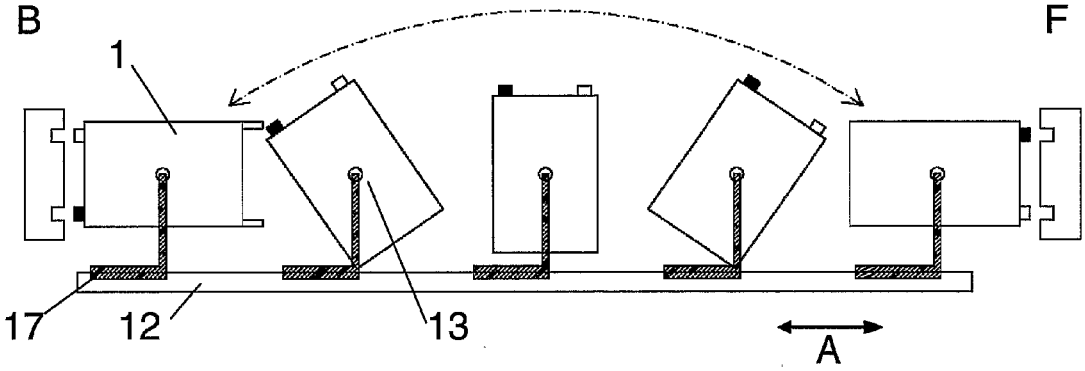
FIGS. 3*b* and 3*c* show side views of the embodiment.

FIGS. 3*a* and 3*b* show a schematic detail for a system including dosing cylinders and actuators according to another embodiment of the invention. In this embodiment the dosing device is moved along a path from the spray gun to the fillings lines and also rotated during the movement. FIG. 3*a* shows a top view of two dosage devices 1*a*, 1*b* arranged on a robot arm (not shown). FIG. 3*b* shows a side view of the two dosing devices, in which each dosage device 1*a*, 1*b* is moveably mounted by means of a pivotable member 13 arranged on the dosing device to co-operate with an actuator arm 17. Actuator arm 17 is arranged moveable, and drivable on a track 12, which track then functions as an actuator, causing each dosing device(s) to be moved backward and forward, in the direction of the arrow A, from the front F position towards the back B position and vice-versa. Actuator arm 17 may conveniently be actuated, moved along track 12, by a compressed air cylinder. In this embodiment the dosage device has an inlet and an outlet valve both mounted on the same end of the dosage device and the dosage device is turned or rotated through substantially 180 degrees so that the inlet and outlet valves of the dosage device may be disconnected from the front (spraying) end, the device moved and rotated, and the valves subsequently connected to the back for filling.

Figure 3C:
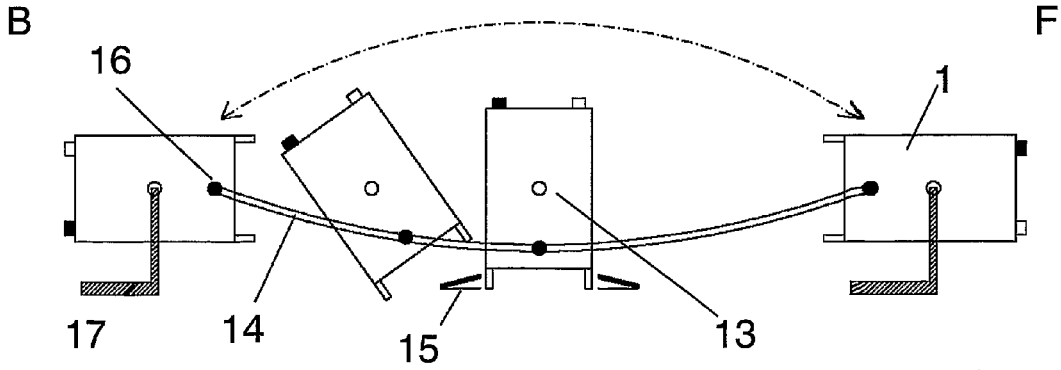

FIG. 3*c* shows a further embodiment in which the rotation movement may be regulated using a rail or guide rail arranged between the front and back ends, parallel to track 12 of FIG. 3*b*. A rail 14 is arranged to guide a locating member 16, a pin, lug or similar, arranged on the dosing device to regulate the rotation of the dosing device about the pivotable member 13, as the dosing device is moved backward and forward along a path which, in the example shown, is substantially straight.

In another embodiment the dosing cylinder is rotated about the main long axis of the cylinder while being moved between eg the spray gun connection at the front end and a filling connection at the back end. The dosing cylinder of this embodiment may comprise one single valve on one end only that functions as both inlet valve and outlet valve. In this case the dosing cylinder with the single valve on one end of it is rotated during movement, eg from the front end from facing the spray gun towards the back, so as to face a valve member connected to filling lines arranged at the back end.

In another embodiment the dosing cylinder has at least two valves, which are both arranged on the same end, as shown in FIGS. 3*a*, 3*b* and 3*c*. The dosing cylinder of this embodiment is also rotated about the main long axis of the cylinder while being moved for example from the spray gun connection at the front end back to a filling connection at the back end.

Figure 6C:
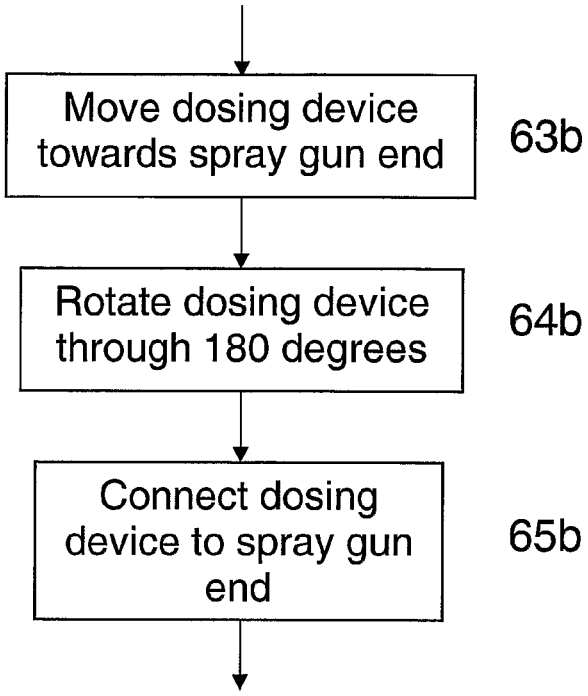
Figure 6D:
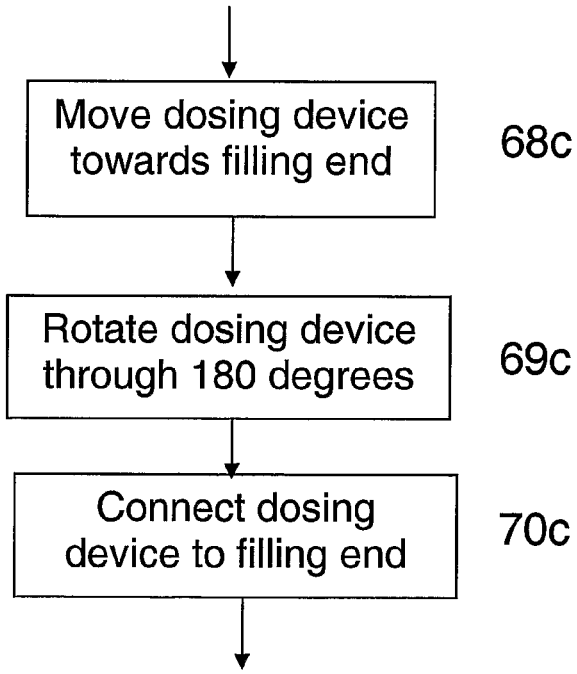
FIG. 6*d* is a flowchart for another preferred embodiment of the invention and in particular in respect of FIGS. 5*a*-*h*.
Figure 6E:
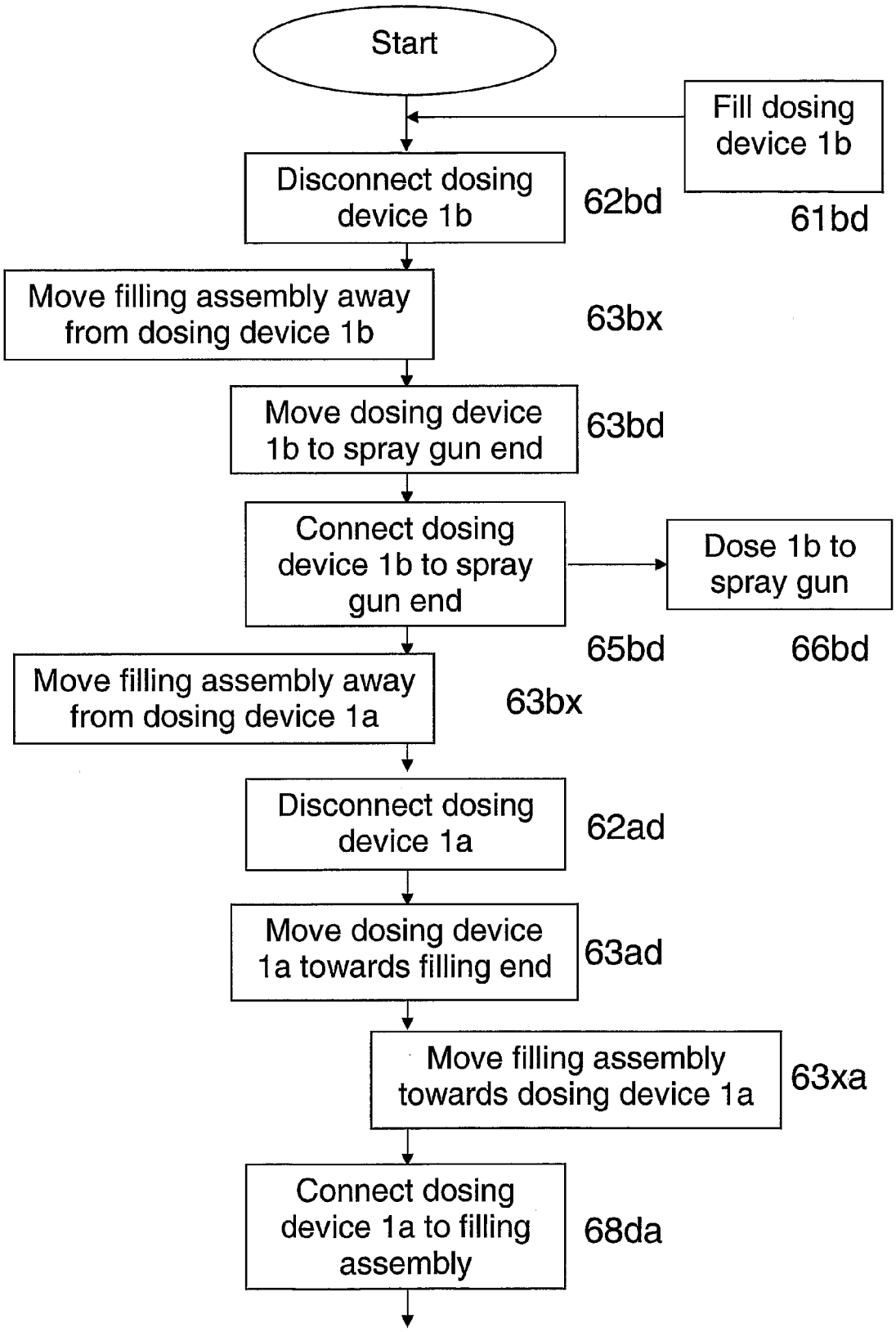

FIGS. 6*c*, 6*d* each show a flowchart for a method to carry out steps for dosing a program controlled spray painting apparatus according to an embodiment in which a dosing device is rotated while disconnected from each end. The figures are numbered to correspond to FIG. 6*a*, where possible, and may be combined with methods shown in FIG. 6*a* and/or 6*b*. FIG. 6*c* shows that after disconnecting a first dosing device from the filling end 62 in FIG. 6*a* the actions of;

moving a dosing device towards the spray gun end 63*b*,
rotating the dosing device through 180 degrees 64*b*,
connecting the rotated dosing device to spray gun end 65*b*.

FIG. 6*d* shows the equivalent operations at the filling end, ie the actions of;

moving a dosing device towards the spray gun end 63*b*,
rotating the dosing device through 180 degrees 64*b*,
connecting the rotated dosing device to the spray gun end 65*b*.

Figure 5A:
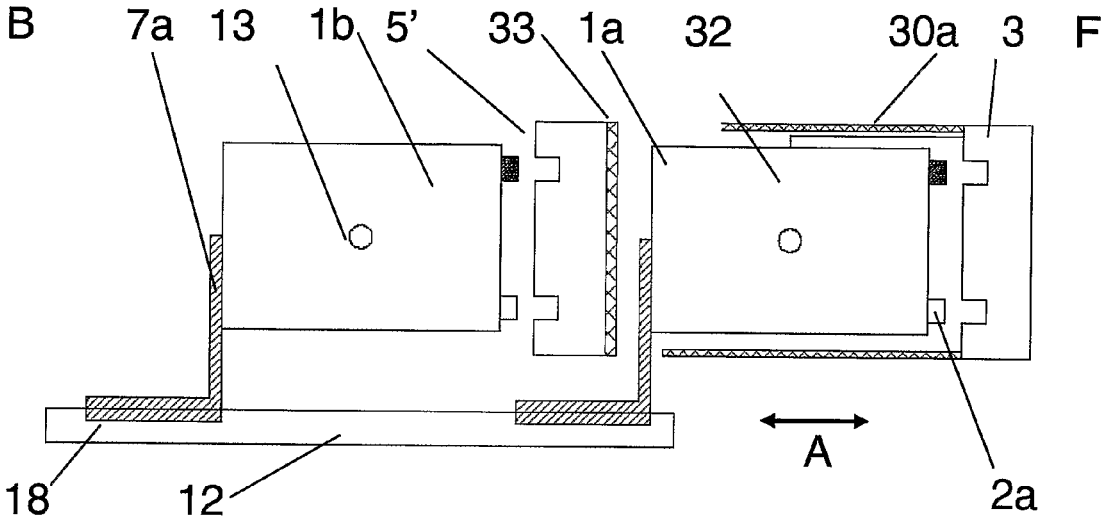
FIG. 5*a* shows a schematic view from one side of two paint dosage devices and two actuators according to another preferred embodiment of the invention.

FIGS. 5*a*-5*i* show another preferred embodiment of the invention. FIG. 5*a* shows a side view of two dosing devices and connection bodies 3, 5' mounted apart on an arm of an industrial robot or other program controlled coating device (not shown). The dosing devices are arranged movable in the direction shown by arrow A, as in the previous embodiments. Each dosing device is mounted with an arm 7*a* on a carrier 18, arranged on a rail 12, which carrier preferably pneumatically driven. FIG. 5*a* shows a dosing device 1*a* on a carrier at the front end (spray gun end) connected to supply paint to the spray gun. Note that the dosing devices and the connection assemblies are shown drawn apart from each other in these figures, in order to simplify understanding of the drawings, whereas it is to be understood that dosing cylinder 1*a* and valve 2*a* are meant to be connected flush to 3*a* at the same time as dosing device 1*b* may be flush with member 5'.

Figure 5B:
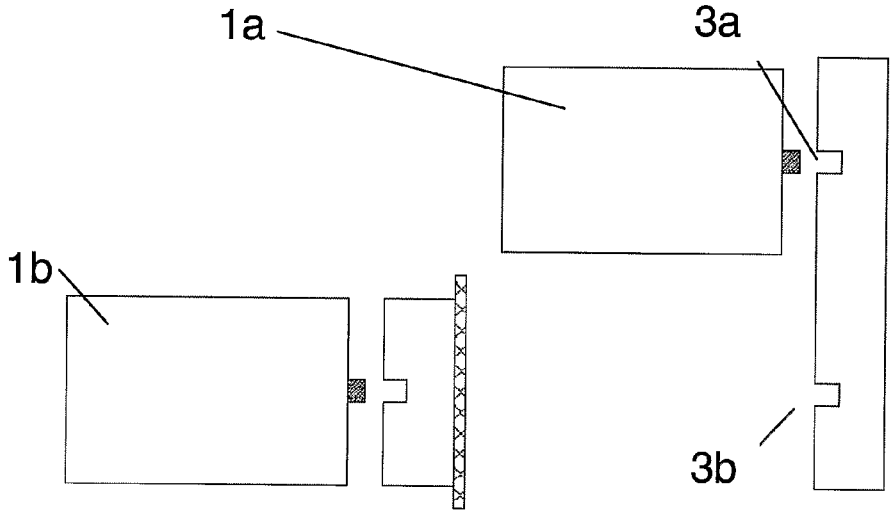
FIGS. 5*b*-5*f* show a view of the embodiment from above diagramming movements of each of the two dosage devices from a spraying position to a filling/cleaning position.
Figure 5C:
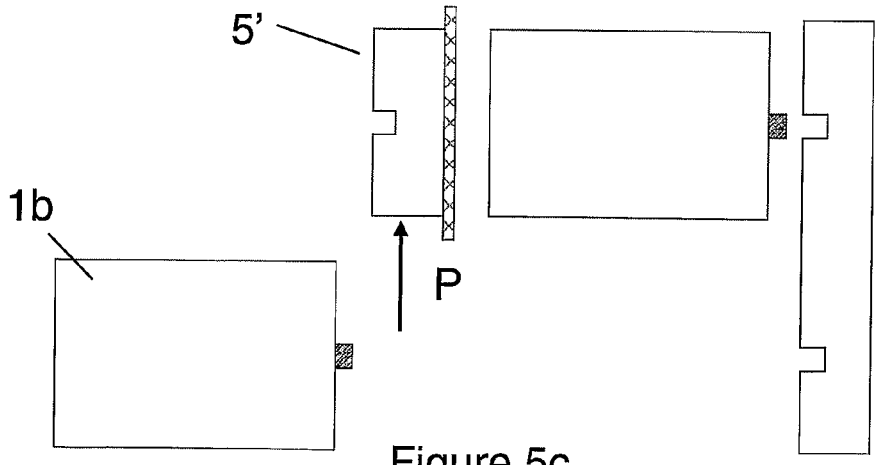
Figure 5D:
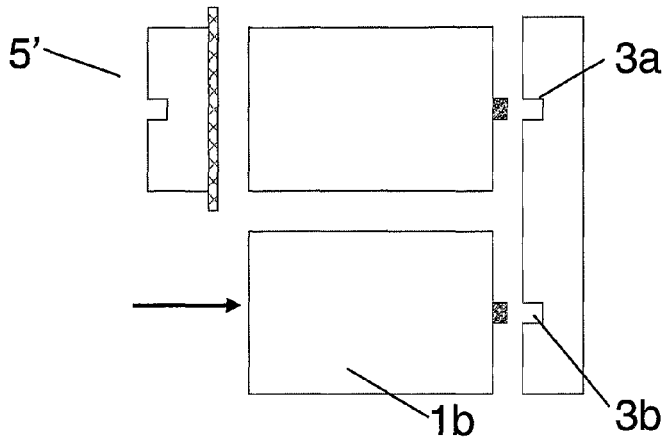
Figure 5E:
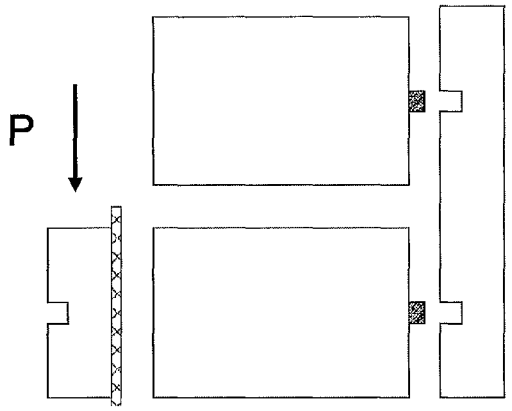
Figure 5F:
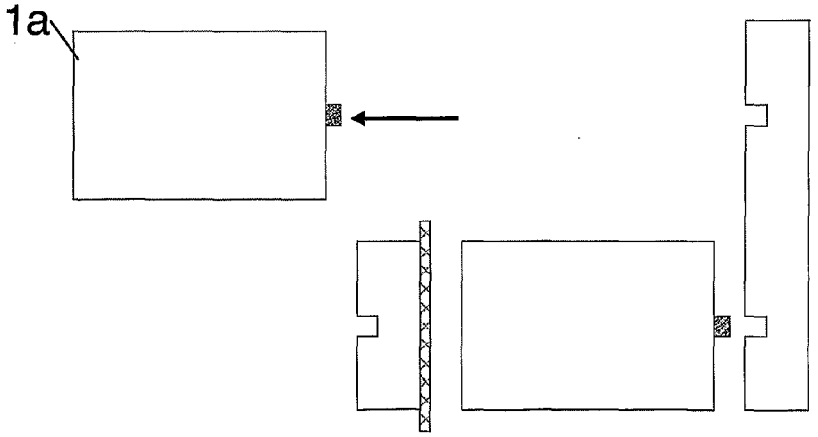
Figure 5G:
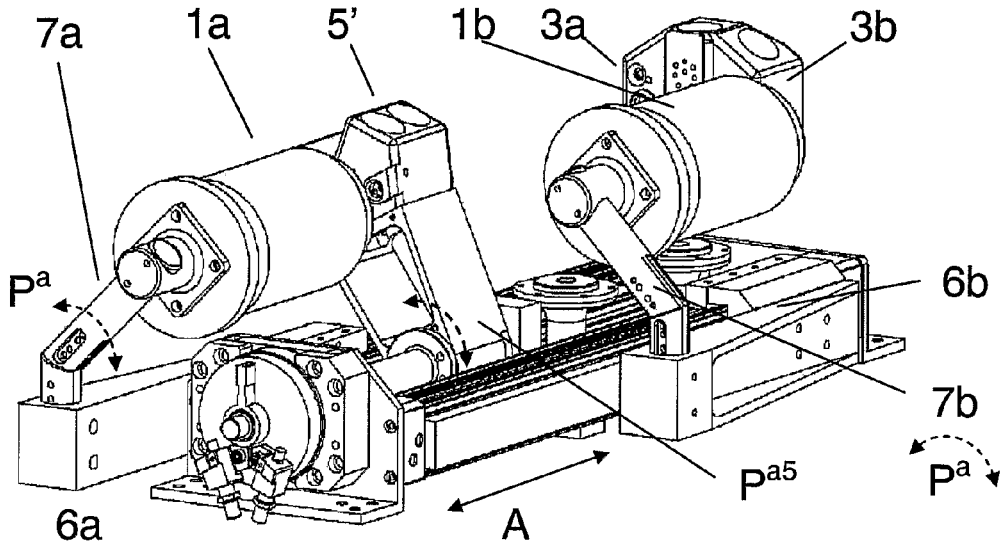
FIG. 5*g* shows a perspective view of the actuators and dosing devices.
Figure 5H:
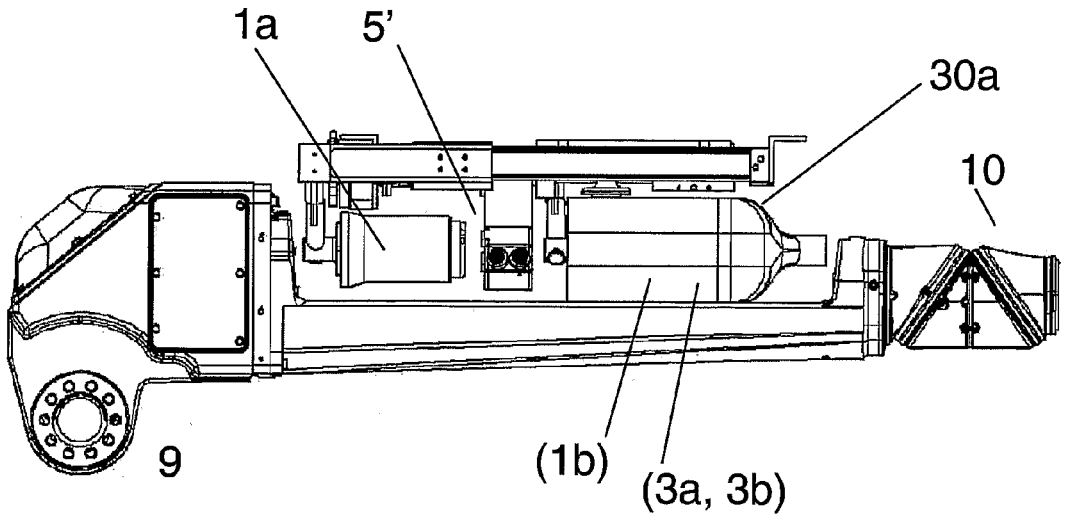
FIG. 5*h* shows a side view of a robot arm with the actuators and dosing devices arranged on it.
Figure 5I:
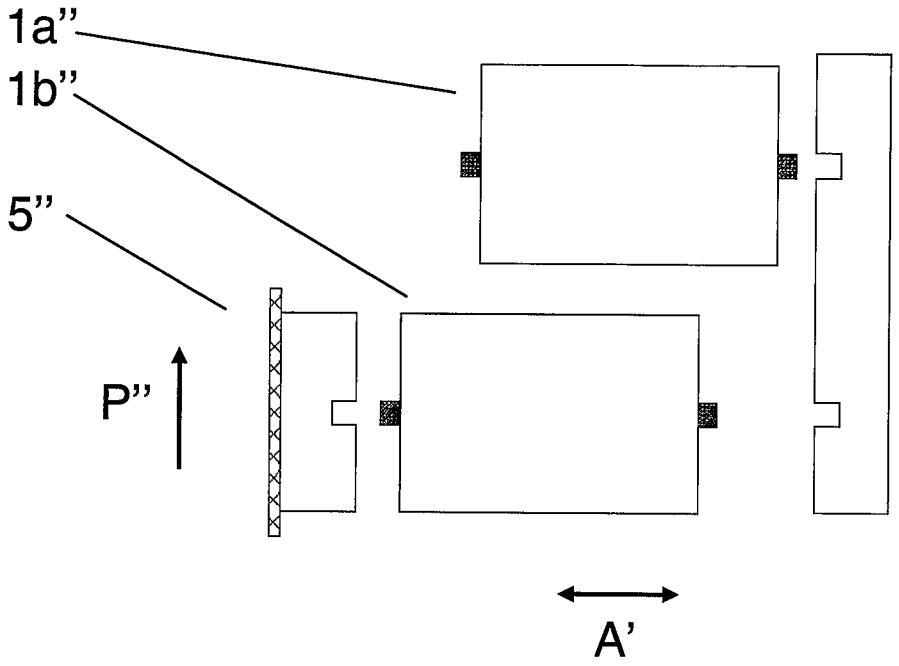
FIG. 5*i* shows a development of the preferred embodiment, showing a double-ended paint dosage device comprising a filling inlet on one end and the tapping/outlet on the other end, and the filler valve block 5 arranged accordingly.

FIG. 5*i* shows a development of the preferred embodiment with a double-ended paint dosage device. FIG. 5*i* shows a dosage device 1*a*" with a filling inlet on one end and a outlet or tapping valve or member on the other end of the long axis of the dosage device. The filler valve block 5" is arranged accordingly to fill the dosage device when, as in the lower position, the dosage device is moved back in direction A away from the spray end for connection to the filler valve block 5" for filling or cleaning.

The connection valves in what corresponds to block 3 of the previous embodiments are partly enclosed by a housing 30*a* comprising insulating material, indicated by a cross-hatched pattern. This housing creates a well-insulated space between grounded parts of the dosing device and/or robot arm and the possible charged parts of the connection valves to the spray head/applicator. As the dosing device 1 is moved into the housing 30*a*, galvanic contact is made by a charging antennae 32, which may be a single electrode, scraper or a brush etc., before the valves of the dosing device make contact with the valves of the docking part to block 3*a*. In addition to this feature a high voltage protection device in the high voltage circuit monitors the current of the high voltage supply to the spray gun/applicator. In the event of a fault which for example causes a rapid increase in magnitude of the HV supply current, the protection device determines a fault situation and shuts off the high voltage current thus terminating any fault current that may have begun to occur. The figure also shows that the connection block 5' has a layer of insulating material 33 on the side of block 5' between block 5' and the dosing device when connected at the spray gun end, in the charged position. This maintains any dosing cylinder 1*a* and/or 1*b* while in any forward position, FIGS. 5*e*, 5*f*, well insulated from block 5'. Connection block 5' may be dimensioned similarly to 3 (or 3*a*, 3*b*) of previous figures but have the equivalent functions of 5 or 5*a*, 5*b* of previous figures, that is, it is a connection member connected to fluid materials supply and/or cleaning fluid supply.

FIGS. 5*b*-5*f* are views from above of the same arrangement of dosing devices 1*a*, 1*b* as FIG. 5*a*, showing a sequence of positions in a method for connecting and disconnecting one or more dosing devices according to the preferred embodiment. FIG. 5*b* shows dosing device 1*a* connected at the front end, spray gun end; and the dosing device 1*b* connected in the back position for filling. (Note that the dosing devices and the connection assemblies are only shown drawn apart from each other to facilitate understanding of the drawings.) Only one connection assembly 5' is necessary in this embodiment for connection to the filling lines for paint etc or cleaning fluid but it may be arranged to supply fluids to one dosing device 1, or two dosing devices 1*a*, 1*b*, or more than two devices.

FIG. 5*c* shows that connection assembly 5' has moved away from dosing device 1*b* in a direction R perpendicular to the direction of movement A of the dosing devices, to allow dosing device 1*b* to be moved up to the front end, spray gun end. FIG. 5*d* shows that dosing device 1*b* has been moved into position and connected via the block 3, 3*a* to the spray gun at the front end. In FIG. 5*e* connection assembly 5' is temporarily moved across behind dosing device 1*b* in the direction R to allow dosing device 1*a* to be withdrawn by an actuator to a back position, shown in FIG. 5*f*. This would be followed by connection assembly moving across for connection to 1*a*.

FIG. 5*g* shows a perspective view in which dosing cylinder actuators 6*a* and 6*b* move between the spray end and the filling end in direction A as before, but in which the arms 7*a*, 7 *b* carry out the movement P of the dosing cylinders perpendicular to the direction A of travel by moving the arms substantially in an arc $P^a$ in a plane perpendicular to the plane that the direction A lies in. The figure shows that each of the dosing cylinders 1*a*, 1*b* may be moved through the arc $P^a$ to be aligned with connections 3*a* or 3*b* in the front end valve block 3, and also that the filling valve block 5' may be moved through an arc $P^{a5}$ that so that each of dosing cylinders 1*a*, 1*b* may be aligned with it.

In the view of FIG. 5*h* a robot wrist 10 may be seen mounted on the front end of a robot arm 9. Mounting the one or more spray gun/applicators on a robot wrist gives greater flexibility to the coating process. For example, objects that are placed very close to one another can be efficiently painted by programming the wrist to point the one or more applicators at each application point or path in turn. FIG. 5*h* also shows one dosing cylinder 1*a* indicated by (1*b*) to mean that the dosing cylinder 1*b* is located inside the shield 30*a* (see FIG. 5*a*) and thus not visible in this view while it is positioned adjacent the front valve block (3) also inside the shield arrangement. Note that the arrangement of FIG. 5*i* provides for a simple forward and back motion for the double-ended dosage device 1*a*" and fewer movements for the filler block 5" to supply one or more dosage devices such as 1*a*". Filler block 5" may move across in the direction P" between supplying device 1*a*" to say 1*b*" in a straight motion as per the embodiments of FIGS. 1*a,b*, 2*a-c*, 4 or may follow an arc of some kind as per the embodiment of FIGS. 3, 5*g*, 5*h*.

FIG. 6*d* is a flowchart for a method to carry out steps for dosing a program controlled spray painting apparatus according to the another preferred embodiment of the invention shown in FIGS. 5*a-f*. The figures are numbered to correspond to FIG. 6*a*, where possible, and may be combined with methods shown in FIGS. 6*a*, 6*b* and/or 6*c*. The method is shown beginning at a point in a operating cycle such as with:

filling a first dosing device 1*b*, 61*bd*, disconnecting 62*bd* the first dosing device from the filling end;

moving filling assembly away 63*bx* from dosing device 1*b;* moving the first dosing device 1*b* to the spray gun end 63*bd;* connecting dosing device 1*b* to an inlet 65*bd* of the spray gun;

dosing 66*bd* first dosing device 1*b* to the spray gun, moving filling assembly away 63*bx* from dosing device 1*a,* disconnecting second dosing device 1*a* from spray gun end 67*ad;* moving second dosing device 1*a* towards filling end 68*ad;* moving filling assembly towards 72*ad* dosing device 1*a;* connecting dosing device 1*a* to an outlet 73*bd* of the filling assembly.

An advantage of this embodiment is that an actuator mechanism such as 5' (or 5" of FIG. 5*i*) may serve or cooperate with more than one dosing device, or even with two or more devices.

In a preferred embodiment the dosing cylinder and actuator are used to apply waterborne paint, for example to exteriors and/or interiors of vehicle bodies, or to vehicle parts. Although most of the examples described have made use of an industrial robot as the program-controlled automation device, there arise situations where the multi-axis capability of a robot may be unnecessary or unduly expensive. Embodiments of the invention may include use together with a more simple manipulator arm with, say, two or more axes of movement. Other applications may even use a simple paint reciprocator type of machine, with spraying movement in one axis only, for example moving up-and-down in a vertical movement in a straight line to coat simple or box-like shapes.

The dosage device 1, 2 and/or the inlet valve 3 and/or filler valve 5 may be arranged with a connection means or any type of quick release coupling that provides connection to the valve member and fluid connection through to the respective inlet or outlet in one action. Thus coupling and connection actions such as 65*a* and 65*a*2 and/or 66*a*3, 67*b* of a method such as shown in the flowchart of FIG. 6*b* may be carried out in a single step.

The dosage device is described above with reference to FIG. 4 as having a regulating piston 51, 51*a*, 51*b* which may be driven by a non-conductive fluid or by a combination of an insulated part and a fluid. In an advantageous development of the preferred embodiment the dosage device is arranged with a DCF, Dosing Control Fluid medium that is conductive and may preferably be water or a water-based fluid.

There are several variations and modifications which may be made to the disclosed solutions, and embodiments of the invention may also be used to coat different types of paint, two-component paint, basecoat, primer and so on. Similarly the above described solutions may also be adapted to coat or spray other substances such as protective coatings, sealants, or adhesives. Methods of the invention may be supervised, controlled or carried out by one or more computer programs. Similarly the one or more dosing devices may be arranged to reciprocate as described along a substantially straight line, but the invention is not limited to movement in a straight line, and the movement path may be adapted to a path of another shape between connection points for filling and spraying, dependent on the shape etc of the automation device or robot arm and the geometry of a coating system.

A spray painting apparatus according to one or more embodiments of the invention preferably comprises one or more microprocessors (or processors or computers) or other form of central processing unit CPU to perform steps of the methods according to one or more aspects of the invention, as described for example with reference to FIGS. 6*a*-6*e*. The method or methods performed with the aid of one or more computer programs, are stored at least in part in memory accessible by the one or more processors. It is to be understood that the computer programs for carrying out methods according to the invention may also be run on one or more general purpose industrial microprocessors, PLCs or computers instead of one or more specially adapted computers or processors.

The computer program comprises computer program code elements or software code portions that make the computer or processor perform the methods using equations, algorithms, data, stored values, calculations and statistical or pattern recognition methods previously described, for example in relation to FIGS. 6*a*-6*e*. The computer program may include one or more small executable programs such as a web client, a web server, Flash (Trade mark) program, Java (Trade Mark) applet. A part of the program may be stored in a processor as above, but also in a ROM, RAM, PROM, EPROM, or EEPROM chip or similar memory means. The or some of the programs in part or in whole may also be stored locally (or centrally) on, or in, other suitable computer readable medium such as a magnetic disk, CD-ROM or DVD disk, hard disk, magneto-optical memory storage means, in volatile memory, in flash memory, as firmware, or stored on a data server. Other known and suitable media, including removable memory media such as Sony Memory Stick™ and other removable flash memories, hard drives etc. may also be used. The program may also in part be supplied from a data network, particularly under a configuration or maintenance operation including a public network such as the Internet. One or more of the computer programs described may also be arranged in part as a distributed application capable of running on several different computers or computer systems at more or less the same time.

It should be noted that while the above describes exemplifying embodiments of the invention, there are several variations and modifications which may be made to the disclosed solution without departing from the scope of the present invention as defined in the appended claims.

The invention claimed is:

1. A program controlled spray painting apparatus to electrically dose conductive fluid materials to a spray gun/applicator, the spray gun/applicator comprising a high tension electrode that electrostatically charged atomizes electrically conductive fluid materials supplied thereto, the spray painting apparatus comprising: a dosing device comprising an inlet conduit through which fluid material and cleaning liquid are alternatively supplied, the dosing device further comprising an outlet conduit to alternately deliver said fluid material and cleaning liquid to, respectively, the spray gun/applicator and a sump for spent cleaning liquid, wherein said dosing device is arranged mounted on a robot arm and movable to connect and disconnect the inlet conduit to a supply connection of said fluid material and cleaning liquid mounted on the robot arm and to connect and disconnect the outlet conduit to the spray gun/applicator and a sump for spent cleaning liquid, wherein said dosing device is movable in relation to the robot arm, and wherein the dosing device is movable in relation to the spray gun/applicator, the sump, the supply connection of said fluid material and cleaning liquid, and wherein the dosing device is arranged movable by an actuator member along a path between the supply connection and a connection point to the spray gun/applicator.

2. The spray painting apparatus according to claim 1, wherein the dosing device is connected to one or more moving parts arranged capable of moving said dosing device along a path between the supply connection and the connection point to said spray gun/applicator.

3. The spray painting apparatus according to claim 1, further comprising:

at least one inlet connection valve disposed in a conduit connected to the inlet conduit.

4. The spray painting apparatus according to claim 3, wherein the at least one inlet connection valve is arranged for connection alternately with paint filling lines and with cleaning fluid lines.

5. The spray painting apparatus according to claim 3, wherein the inlet conduit of the dosing device is arranged connectable to a grounded valve assembly arranged to cooperate with the dosing device through which fluid material and cleaning liquid are alternatively supplied.

6. The spray painting apparatus according to claim 1, further comprising:

at least one outlet connection valve is arranged for connection alternately to the spray gun/applicator or to the sump for spent cleaning liquid.

7. The spray painting apparatus according to claim 1, wherein the dosing device is arranged mounted on an automation device such that the outlet conduit is arranged in closer proximity to a connection point to said spray gun/applicator than to a back end of the automation device.

8. The spray painting apparatus according to claim 7, wherein the dosing device is arranged mounted such that when it the dosing device is placed in a filling position there is an air gap between the dosing device and the connection point to said spray gun/applicator.

9. The spray painting apparatus according to claim 1, wherein the dosing device is arranged with one conduit that functions alternately as the inlet conduit and as the outlet conduit.

10. The spray painting apparatus according to claim 1, wherein the inlet conduit and the outlet conduit are each arranged at the same end of the dosing device.

11. The spray painting apparatus according to claim 1, wherein the inlet conduit and the outlet conduit are each arranged at opposite ends of the dosing device.

12. The spray painting apparatus according to claim 1, wherein the dosing device is arranged connectable to an outlet connection valve of the spray gun/applicator, wherein the outlet connection valve is arranged in a member comprising a housing comprising at least one shielding part made from an insulating material.

13. The spray painting apparatus according to claim 1, wherein the dosing device is arranged with an electrically conductive grounding member for equalizing and reducing electrical potential fields or corona field differences between the dosing device and an outlet connection valve of the spray gun/applicator.

14. The spray painting apparatus according to claim 1, further comprising:

a dosing cylinder in which a regulator or piston is arranged for moving said fluid material out from the dosing device and, wherein the piston is arranged with a drive member comprising any from the list of: a non-conductive fluid, air, an electric motor, an electric motor with a screw drive, an electric motor with a drive member made from insulating material.

15. The spray painting apparatus according to claim 1, further comprising:

a dosing cylinder in which a regulator or piston is arranged for moving said fluid material out from the dosing device and, wherein the piston is arranged with drive member comprising a drive control fluid comprising a substantially conductive fluid or water.

16. A program controlled spray painting apparatus to electrically dose conductive fluid materials to a spray gun/applicator, comprising:

a spray gun/applicator;

a sump for spent cleaning liquid mounted on a robot arm;

a supply connection of said fluid materials mounted on the robot arm;

a supply connection of cleaning liquid mounted on the robot arm;

a high tension electrode that electrostatically charged atomizes electrically conductive fluid materials supplied thereto; and a dosing device comprising an inlet conduit through which fluid material and cleaning liquid are alternatively supplied, the dosing device further comprising an outlet conduit to alternately deliver said fluid material and cleaning liquid to, respectively, the spray gun/applicator and the sump, wherein said dosing device is mounted on the robot arm and is movable in relation to the robot arm so as to connect and alternatively disconnect the inlet conduit to the supply connection of said fluid material and cleaning liquid and connect and alternatively disconnect the outlet conduit to the spray gun/applicator and the sump, and wherein the dosing device is movable in relation to the spray gun/applicator, the sump, the supply connection of said fluid material and cleaning liquid.

* * * * *